United States Patent [19]

Studholme

[11] Patent Number: 4,776,396

[45] Date of Patent: Oct. 11, 1988

[54] APPARATUS FOR CONTROLLING INFLATION FLUID TO AND FROM INFLATABLE PACKER ELEMENTS

[75] Inventor: Gordon Studholme, Edmonton, Canada

[73] Assignee: Mandarin Oilfield Services Ltd., Calgary, Canada

[21] Appl. No.: 21,254

[22] Filed: Mar. 3, 1987

[30] Foreign Application Priority Data

Mar. 7, 1986 [CA] Canada ..... 503513

[51] Int. Cl.[4] ..... E21B 33/127

[52] U.S. Cl. ..... 166/187; 166/106; 166/242

[58] Field of Search ..... 166/187, 106, 242, 191; 175/324, 99, 230

[56] References Cited

U.S. PATENT DOCUMENTS

| | | | |
|---|---|---|---|
| 2,894,585 | 7/1959 | Erwin | 175/324 X |
| 2,978,046 | 4/1961 | True | 166/187 X |
| 3,503,445 | 3/1970 | Coehrum et al. | 166/187 X |
| 3,941,190 | 3/1976 | Conover | 166/187 |
| 4,367,794 | 1/1983 | Bednar et al. | 166/187 X |
| 4,424,860 | 1/1984 | McGill | 166/187 X |

FOREIGN PATENT DOCUMENTS 1142848 3/1983 Canada .

*Primary Examiner*—Hoang C. Dang

*Attorney, Agent, or Firm*—Bradford E. Kile

[57] ABSTRACT

Apparatus for controlling the flow of inflation fluid to an inflatable packer elements forming part of a drill stem tester, comprises a hydraulically operated piston and adaptor assembly to inflate and deflate the packer elements. The initial flow of inflation fluid into the assembly causes the piston to move upward, aligning a conduit in the piston with a conduit in the adaptor. A valve permits passage of the inflation fluid to the packer elements through the conduit in the piston when the conduit in the piston are in alignment with the conduit in the adaptor. An increase in the pressure of the inflation fluid surrounding the piston causes a second valve in the adaptor to open, thereby allowing the piston to move downward and the pressure fluid from the packer elements to flow to the well bore.

8 Claims, 3 Drawing Sheets

APPARATUS FOR CONTROLLING INFLATION FLUID TO AND FROM INFLATABLE PACKER ELEMENTS

FIELD OF THE INVENTION

The present invention relates to a release system for the inflatable packer elements which are used with a drill stem tester.

BACKGROUND OF THE INVENTION

In order to evaluate the oil and gas producing potential of geological formations, it is known to attach a formation testing tool to a drill stem and lower the same into an inclosed well bore. Packer elements, which are used to isolate the zone which is to be tested for its producing potential, are lowered into the bore hole in a deflated state. When the formation testing tool attached to the drill stem is at the appropriate depth, the packers inflate on either side of the zone. After the test has been completed, the packers are deflated in order to permit the drill stem to be moved again.

Various inflatable packer systems have been proposed for use with drill stem testers. Some systems make use of the drill pipe rotation to actuate a piston pump which displaces fluid into the packer elements; in other systems, the drill pipe reciprocation actuates the piston pump to displace the fluid into the packer elements. The set-down movement of the drill pipe can also be used to move a piston to displace fluid into the packer elements. In still other systems, the drill pipe rotation or weight set-down opens a valve allowing compressed gas from a tank to move a piston so as to displace fluid into the packer elements.

Canadian Pat. No. 1,142,848 discloses one inflatable packer system which has been used in drill stem testing in the Canadian west. The system disclosed in the patent uses a rotary pump, actuated by rotating the drill stem, to pump drilling mud to the packer elements. A check relief valve is provided to guard against packer deflation in case of a loss of pump pressure, and against over-inflation and rupture of the packer elements. The valve subassembly incorporates a shifting sleeve which is pumped down upon initial operation of the pump. Pumping down the shifting sleeve opens a passage between the pump outlet and the packer elements so as to permit inflation of the packer elements.

When the packer system is inflated, weight is set-down on the drill stem to collapse the inner portion of the valve with respect to the outer portion of the valve. Initial movement of the inner portion of the valve isolates and seals off the packer elements; further movement vents inflation fluid from the pump to the well. Packer deflation is accomplished by lifting the drill stem to stretch the valve to its original elongated position. Initial lifting of the inner portion of the valve opens the vent to the well bore from the isolated zone to equalize the pressure in the zone with that in the well bore; further lifting causes the shifting sleeve to be picked up and opens a passage to the well bore from the interior of the packer elements, for deflation thereof.

In the operation of this prior art system, a mechanical latch must be released by pressure from the rotary pump in order to inflate the packer elements. This is a potential area of difficulty, where wearing or jamming may occur. Furthermore, in order to open a path for pressure fluid between the formation and the surfaee, the formation flow ports in the tool must move to open up relief ports between the pump and the release mechanism; the port is opened to the well bore after a short movement of the tool, so as to relieve any excess pressure, and then the port is resealed before the main valve opens. This design requires that the pressure between the pump and the release system be relieved, thus necessitating additional features. Finally, to release the packer elements, the ports must be aligned; again, the need to perform a mechanical latching operation presents an area vulnerable to wear and failure.

SUMMARY OF THE INVENTION

The present invention relates to a release system for use with inflatable packer elements forming part of a drill stem tester, comprising a hydraulically operated piston and upper adaptor assembly to inflate and deflate the packer elements. The initial flow of inflation fluid into the assembly causes the piston to move upward, aligning conduit means in the piston with conduit means in the upper adaptor. A valve permits passage of the inflation fluid to the packer elements through the conduit means in the piston when the piston is in alignment with the conduit means in the upper adaptor. An increase in the pressure of the inflation fluid causes a second valve in the upper adaptor to open, thereby allowing the piston to move to uncover the conduit means in the piston to the well bore, so that the pressure fluid from the packer elements can flow through such conduit means to the well bore.

More particularly, this invention relates to a device adapted to be positioned in a drill string to control the supply of inflating fluid to and from an inflatable packer. The device is The first element is attached to the upper portion of the drill string, and has first conduit means which convey pressure fluid from the upper portion of the drill string. (The pressure fluid is usually generated by a pump in the drill string just a short distance above the release device.)

The second element is atached to the lower portion of the drill string and has second conduit means to convey pressure fluid to and from inflatable packer elements associated with the lower portion of the drill string.

A piston is provided which is moveable between two positions. In a first position, the first and second conduits are in register with one another, so that pressure fluid can flow from the upper part of the drill string through the first and second conduit means to inflate (or keep inflated) the packer elements. In a second position, the first and second conduits are out of register, and the second conduit is open to the well bore so that fluid will flow from the packer elements to the well bore, causing them to deflate.

In the preferred embodiment, the piston is caused to move towards the first position when the fluid in the first conduit is under pressure. When the fluid in the first conduit drops to the ambient pressure of the well bore, the piston moves to the second position. However, it is possible to cause piston movement in other ways, as by vertically moving the drill string from the ground surface. In the preferred embodiment as well, the first element defines the cylinder in which the piston travels, and the piston is integral with the second element. However, it will be evident to one skilled in the art that it is possible to have the second element define the cylinder, with the piston being integral with the first element. Such variations are within the scope of the invention, provided the piston moves from a first position where the first and second conduit means are in register to a second position where the second conduit means is open to the well bore.

Suitably, a first valve is provided to close off the first conduit means when it is not in register with the second conduit means. The valve is designed to open when the two conduit means are in register. This valve is not essential to the operation of the apparatus, but it is desirable to provide it, as otherwise the pressure of fluid in the first conduit may abrade the O-ring seals between the piston and the cylinder when the first and second conducts approach their in-register position. It is also convenient to have a second valve as an overpressure valve to reduce pressure in the first conduit means so that the piston can return to the second position. This permits the operator to actuate movement of the piston to the second position very simply, merely be causing excess pressure in the first conduit means, so as to cause the overpressure valve to open.

DETAILED DESCRIPTION

A preferred embodiment of the invention will now be described in detail in conjunction with the attached drawings.

Figure 1:
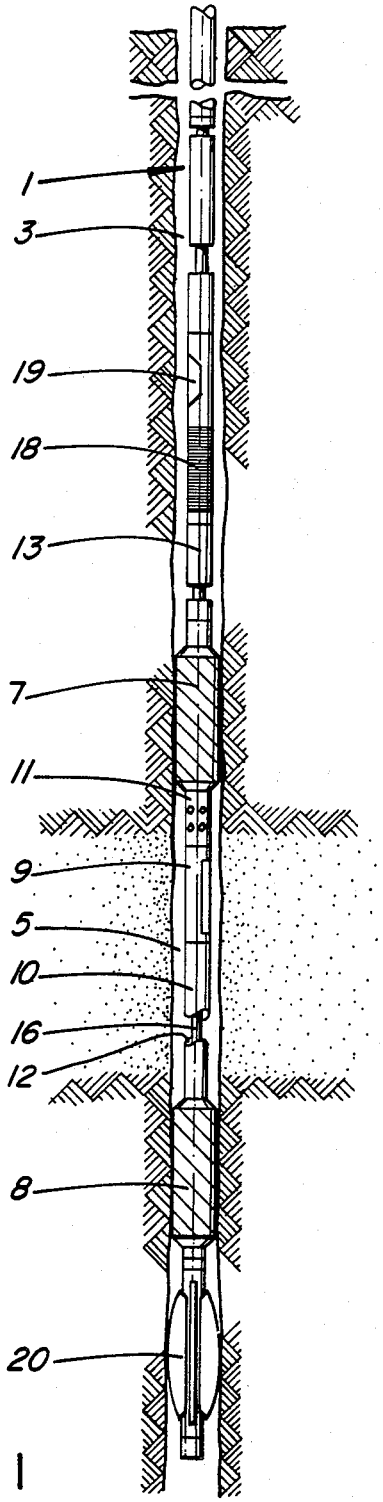
FIG. 1 depicts a drill stem testing system with which the release of the present invention can be used.

The drill stem tester shown generally as 1 in FIG. 1 is inserted into bore hole 3. Drill string tester 1 has upper inflate packer 7 and lower inflate packer 8 disposed about zone 5, the zone which is being tested. Recorder carrier 9 and spacer 10 are located between upper inflate packer 7 and lower inflate packer 8; recorder carrier 9 is used to carry the instruments which record the data from the tests carried out when fluid is forced into the formation through formation flow ports 11. Release device 13 is fitted above upper inflate packer 7 and is in fluid connection with upper inflate packer 7; release device 13 is also in fluid connection with lower inflate packer 8, by means of annular conduit 12 in space 10 around conduit 16. Conduit 16 is the central bore through which the formation flows to the surface during the testing procedure. Located above release system 13 are suction screen 18 and inflate pump 19. Drag spring 20, below lower inflate packer 8, engages the wall of well bore 3 and prevents the system from turning as drill stem tester 1 is rotated.

Figure 2:
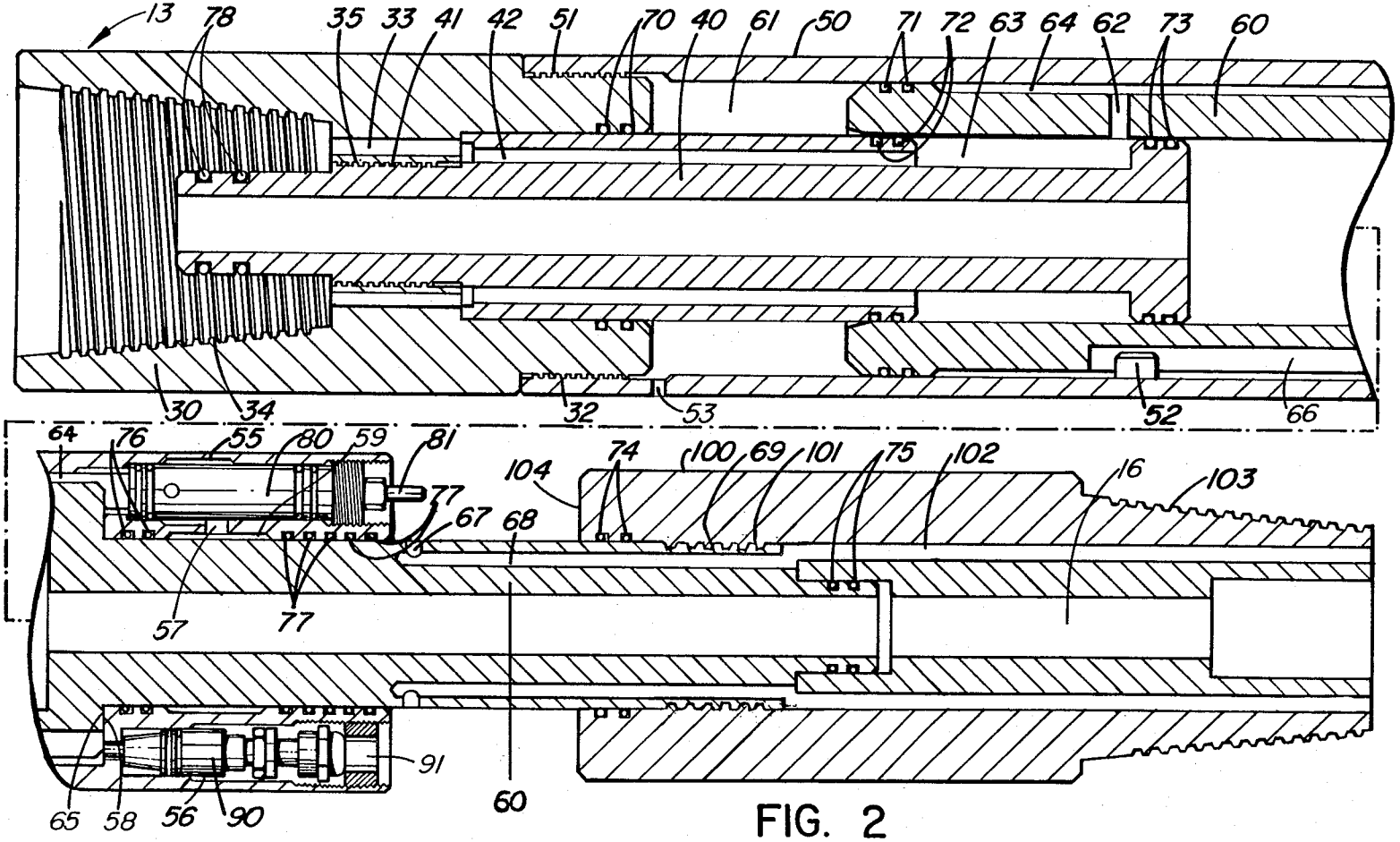
FIG. 2 depicts a longitudinal section through the release device shown in FIG. 1, the piston being in the position associated with fully deflated packers.

Release system 13 is depicted in detail in FIG. 2. Release system 13 includes upper adaptor 30, flow mandrel 40, cylinder 50, piston 60, and lower adaptor 100. The upper adaptor, flow mandrel and cylinder together form the first element, or upper element, of the invention in this embodiment. Lower adapter 100 is the second element, and is integral with piston 60.

Internally threaded portion 35 of upper adaptor 30 is fitted to externally threaded portion 41 of flow mandrel 40. Upper adaptor 30 has formed therein passages 33 in fluid connection with passages 42 formed in adjacent flow mandrel 40. In the embodiment shown there are four passages 33 spaced around the diameter of the adaptor 30 and four connecting passages 42 in the flow mandrel but the number of such passages is not critical. Conventional O-rings 70 between upper adaptor 30 and flow mandrel 40 provide a seal therebetween. Upper adaptor 30 is fitted to the lower portion of suction screen 18 of the upper part of drill stem tester 1 by means of internally threaded portion 34. Conventional O-rings 78 provide a seal between flow mandrel 40 and an unthreaded lower portion of section screen 18.

Cylinder 50 has internally threaded portion 51 fitted to externally threaded portion 32 of upper adaptor 30. Piston 60 lies between flow mandrel 4, and cylinder 50; conventional O-rings 71 provide a seal between piston 60 and cylinder 50, and conventional O-rings 72 and 73 provide a seal between piston 60 and flow mandrel 40.

Piston 60 is capable of longitudinal movement in cavity 61 which extends between flow mandrel 40 and cylinder 50, cavity 61 having venting aperture 53 open to the well bore to relieve pressure build-up from such movement. Pin 52 protrudes from cylinder 50 and slides in a slot 66 provided in piston 60 as the piston moves so that piston 60 is not free to rotate relative to cylinder 50. Piston 60 has formed therein passage 62, passage 62 being in fluid connection with annular cavity 63 between piston 60 and flow mandrel 40 and in fluid connection with annular passage 64 between piston 60 and cylinder 50. Cavity 63 is in fluid connection with passages 42 formed in flow mandrel 40 and thence with passages 33. Passages 33, 42, 63, 62, and 64 together define, in his embodiment, the "first conduit means" of the invention.

Piston 60 narrows at the lower potion thereof, wherein cylinder 50 has formed recesses containing valve assemblies 80 and 90. Piston 60 has formd therein, below valve assemblies 80 and 90, passages 67 in fluid connection with passage 68 which extend the remainder of the longitudinal length of piston 60.

Externally threaded lower portion 69 of piston 60 is fitted into internally threaded portion 101 of lower adaptor 100. Lower adaptor 100 has formed therein passages 102, passages 102 being in fluid connection with passage 68. In the embodiment shown there are four such passages, spaced around the diameter of the lower adaptor, but the number of such passages is not critical. These passages together with passages 67 and 68 form the "second conduit means" of the invention in this emodiment. Lower adaptor 100 is fitted to upper inflate pacer 7 of the lower part of drill stem tester 1 by means of externally threaded portion 103. Conventional O-rings 674 and 75 between piston 60 and lower adaptor 100 provide a seal therebetween.

Valve assembly 80, located in a recess between cylinder 50 and piston 60, is a pump-up valve for inflating packer elements 7 and 8. Valve assembly 80 is in contact with annular passage 64 at the upper end thereof and discharges into annular space 55. Conventional O-rings 76 and 77 form a seal between piston 60 and cylinder 50, and O-rings surroundng the valve prevent fluid passage from passage 64 to space 55, so that valve assembly 80 provides the only means whereby fluid can pass through passages 64 and continue to flow downward toward packer elements 7 and 8. Valve assembly 80 has pin 81 at the lower end thereof. Pin 81 is a contact pin, such that contact of pin 81 by upper parl 104 of lower adaptor 10 causes valve assembly 80 to pen, thereby permitting the flow of fluid from passages 64 through valve assembly 80 to annular space 55 to aperture 57 and annular passage 59, and thence through passages 67, 68 and 102 to packer elements 7 and 8.

Valve assembly 90, located in recess 56 between piston 60 and cylinder 50, is a relief valve for use in deflating packer elements 7 and 8. Valve assembly 90 is set at a certain pressure level, such that excess pressure above the preset level causes valve assembly 90 to open and to permit fluid from annular passage 64 to flow through valve outlet 91 to well bore 3. O-rings surrounding the valve prevent leakage around it when the valve is closed. An example of a commercially available valve assembly suitable for use as valve assembly 90 is the "Nupro R3A series," (trade mark) externally adjusted relief valve, manufactured by the Nupro company In order to fill packer elements 7 and 8, inflate pump 19 draws the drilling mud which is the pressure fluid from well bore 3 through suction screen 18 to release system 13. The fluid enters passages 33 of upper cylinder 30 and passes therethrough to passages 42 of flow mandrel 40. The fluid continues to flow through passages 42 and fills cavity 63 between flow mandrel 40 and piston 60. The fluid then flows through passage 62 in piston 60 to annular passage 64 between cylinder 50 and piston 60.

Figure 3:
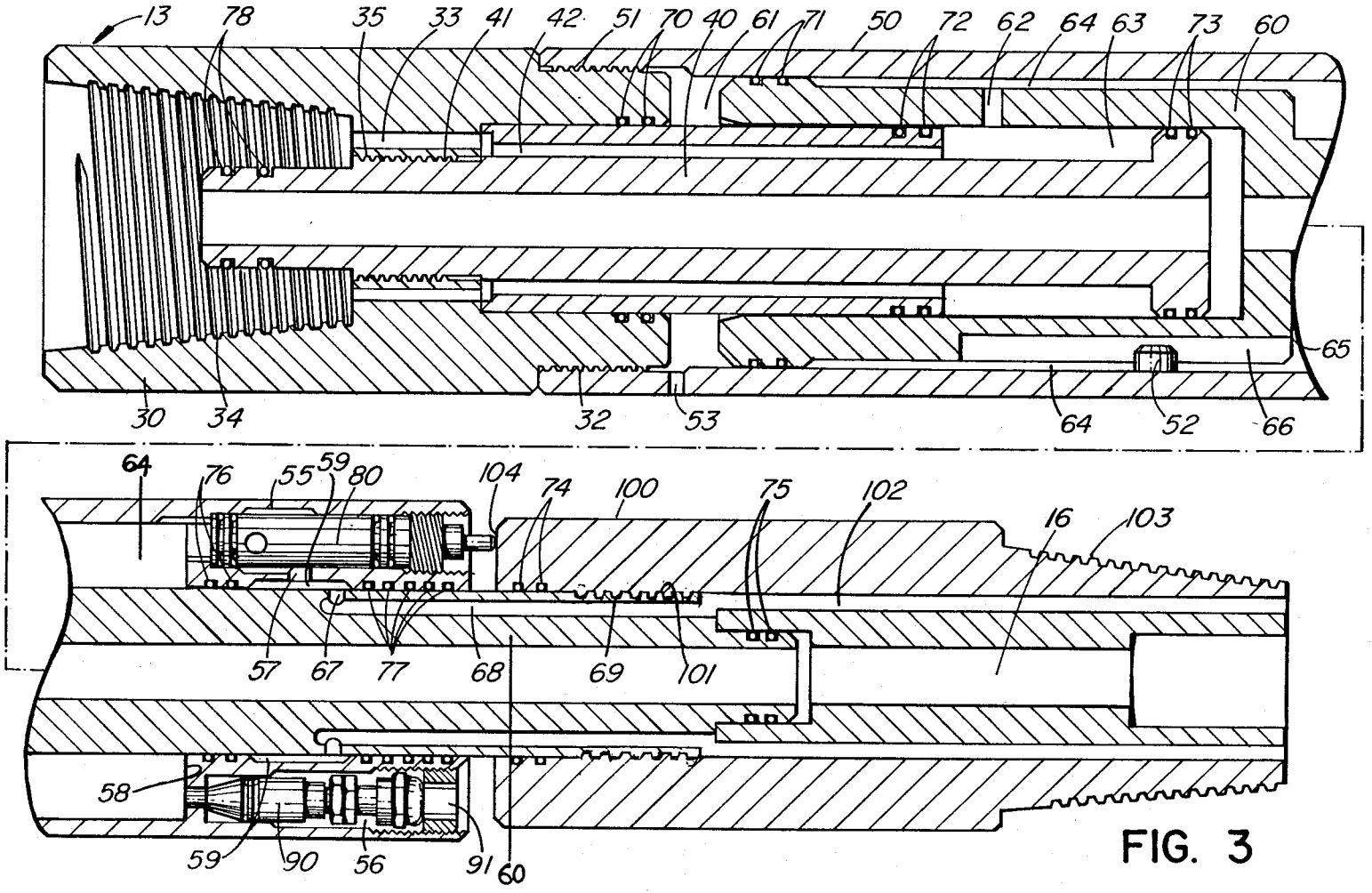
FIG. 3 depicts a longitudinal section through the release device shown in FIG. 1, the piston being in the position it assumes when the packer is inflated.

The increasing pressure of the pressure fluid causes piston 60 to move in a longitudinally upward direction with respect to cylinder 50. Being screwed to piston 60, lower adaptor 100 also moves upward. When upper part 104 of lower adaptor 100 makes contact with pin 81 of valve assembly 80, pin 81 causes valve assembly 80 to open, thereby permitting the pressure fluid to flow from passages 64 to annular recess 55 and thence through outlet aperture 57 to passages 67, which are in fluid connection with passages 68 in piston 60 and passages 102 in lower adaptor 100 as shown in FIG. 3. The pressure fluid is thus able to flow through passages 102 to packer element 7, and to packer element 8 by means of annular conduit 12. Packer elements 7 and 8 are inflated by the accumulation of the pressure fluid. After packer elements 7 and 8 have been inflated, the test of zone 5 can be conducted in conventional manner.

After the test of zone 5 has been completed, the fluid in packer elements 7 and 8 must be released to enable packer elements 7 and 8 to deflate and thereby permit drill stem tester 1 to be moved. An upward pull is exerted from ground level on the drill stem. This causes upper adaptor 30 and parts 40 and 50 (which are rigidly connected to it) to move upwardly. Piston 60 does not move upwardly, due to the weight of the lower drill string and because the inflated packers are engaging the well bore. Therefore, the pressure of the fluid in cavity 63 between the piston and mandrel 40 increases. This increase in pressure is transmitted to the fluid in the remainder of the first conduct means, including annular passage 64. When the fluid pressure in passage 64 exceeds the set pressure of relief valve 90, valve 90 opens and the fluid flows through outlet 91 to well bore 3. After the fluid is released, piston 60 is free to move in a downward direction and does so as the drill string is pulled upwardly from ground level. Piston 60 continues to move downward until shoulder 65 thereof engages the shoulder 58 on cylinder 50. As piston 60 moves downward, passages 67 are no longer sealed from the well bore by O-rings 77 in the lower portion of cylinder 50; passages 102 through lower adaptor 100 and 68 through piston 60 therefore come into connection with well bore 3. This permits fluid from packer elements 7 and 8 to flow through passages 102, 68 and 67 to well bore 3. Escape of pressure fluid from packer elements 7 and 8 causes packer elements 7 and 8 to deflate, thereby enabling drill stem tester 1 to be removed from the well.

It is seen that the use of the release device herewith described does not require that the release system be connected mechanically to the pump, thus obviating the necessity for connecting or latching operations. Reliability is increased because the entire release operation is performed hydraulically, rather than partially or entirely by mechanical means. The entire system design is simplified, and this minimizes the possibility of component failure.

The foregoing has shown and described a particular embodiment of the invention, and variations thereof will be obvious to one skilled in the art. Accordingly, the embodiment is to be taken as illustrative rather than limitative, and the true scope of the invention is as set out in the appended claims.

What is claimed is:

1. A device adapted to be positioned in a drill string to control the supply of inflation fluid to and from an inflatable packer, which device comprises a first element having a bore extending therethrough, first connecting means on said first element to connect said first element as a downward extension to the portion of said drill string above the device, first conduit means in said first element and radially spaced from said bore for fluid connection with a fluid passage in said portion of the drill string above the device a second element having a bore extending therehrough, second connecting means on said second element to connect said second element as an upward extension to the portion of said drill string below the device, a second conduit means in said second element and radically spaced from said bore of said second element for fluid connection with a fluid passage in said portion of the drill string below the device, one of said first and second elements defining a piston and the other of said first and second elements defining a cylinder, the piston being slidably mounted in said cylinder for movement from a first position to a second position, said first and second elements moving longitudinally relative to one another as the piston moves from said first position to said second positon, said first and second conduit means not being in fluid communication with one another and said second conduit means being in fluid communication with the exterior of the drill string when said piston is in said first position, and said first and second conduit means being in fluid communication with one another when said piston is in its second position.

2. A device as claimed in claim 1, additionally comprising a normally closed valve preventing passage of pressure fluid from said first conduit means to the exterior of the device, said valve being an overpressure valve set to open when a predetermined pressure is exceeded by the fluid in the first conduit means.

3. A device as claimed in claim 1, in which said piston moves to assume said first position when the pressure in said first conduit means is increased, and in which said piston can resume said second position when the pressure in said first conduit means is reduced to ambient well pressure.

4. A device as claimed in claim 1, additionally comprising a normally closed valve preventing escape of pressure fluid from said first conduit means, and means to open said valve when said piston is in said second position, whereby to permit flow of pressure fluid into said second conduit means.

5. A device as claimed in claim 1 in which said second element defines the piston and said first element defines the cylinder in which the piston is movable.

6. A device as claimed in claim 5 in which the piston is urged from said first position to said second position upon increase of pressure in the first conduit means.

7. A device as claimed in claim 1 having first normally closed valve means which open when the piston is in said second position, the opening of said first valve when the piston is in said position means causing fluid connection between said first and second conduit means, and second normally closed valve means which open when the pressure in said first conduit means exceeds a predetermined pressure, the opening of said second normally closed valve means causing fluid connection between said first conduit means and the exterior of the drill string.

8. A device as claimed in claim 7 in which said first and second normally closed valve means are attached to the first element, and the first normally closed valve means comprises a contact pin which contacts the second element when said piston is in the second position, said contacting of said contact pin with the second element causes said first normally closed valve means to open.

* * * * *